United States Patent [19]

Domian

[11] Patent Number: 4,833,810

[45] Date of Patent: May 30, 1989

[54] FIREARM

[75] Inventor: Robert E. Domian, Somers, Conn.

[73] Assignee: Dan Wesson Arms, Inc., Monson, Mass.

[21] Appl. No.: 101,061

[22] Filed: Sep. 25, 1987

Related U.S. Application Data

[63] Continuation of Ser. No. 829,234, Feb. 14, 1986, abandoned.

[51] Int. Cl.[4] ..... F41C 21/16; F41G 1/06

[52] U.S. Cl. ..... 42/59; 42/100; 42/77

[58] Field of Search ..... 42/59, 77, 100, 102; 89/29

[56] References Cited

U.S. PATENT DOCUMENTS

| | | | |
|---|---|---|---|
| 183,993 | 10/1876 | Waltis | 42/77 |
| 194,489 | 8/1877 | Wallis | 42/77 |
| 1,297,891 | 3/1919 | Moor | 42/77 |
| 2,438,601 | 3/1948 | Davis | 42/100 |
| 3,303,594 | 2/1969 | Lewis | 42/59 |
| 4,017,495 | 4/1977 | Hughes, Jr. | 42/100 |
| 4,228,606 | 10/1980 | Casull | 42/59 |
| 4,304,061 | 12/1981 | Brouthers | 42/77 |

FOREIGN PATENT DOCUMENTS

| | | | |
|---|---|---|---|
| 210270 | 1/1924 | United Kingdom | 42/77 |

OTHER PUBLICATIONS

*Illustrated Firearms Assembly Handbook,* "Smith & Wesson K 38 Heavyweight Materpiece", E. J. Hoffschmidt, pp. 62-63.

*American Rifleman,* Jul. 1959, p. 30.

*Primary Examiner*—Deborah L. Kyle

*Assistant Examiner*—Michael J. Carone

*Attorney, Agent, or Firm*—Wolf, Greenfield & Sacks

[57] ABSTRACT

For a handgun, interchangeable barrel and shroud combinations including a short barrel and shroud adapted to be interchanged with a longer barrel and shroud in which the longer shroud has integral therewith, a rearwardly extending elongated arm for supporting from the rear end thereof, a rear sight. The rear sight may be adjustable for elevation only or for elevation and windage.

19 Claims, 5 Drawing Sheets

FIREARM

This application is a continuation of application Ser. No. 06/829,234, filed Feb. 14, 1986, and now abandoned.

BACKGROUND OF THE INVENTION

The present invention relates in general to an improved firearm barrel and shroud construction and pertains, more particularly, to interchangeable barrel/-shroud constructions for handguns.

U.S. Pat. Nos. 4,058,050 and 4,304,061 both illustrate handgun constructions that employ a barrel and shroud construction in which the shroud encloses the barrel and in which the barrel and shroud are secured to the handgun frame by a securing nut or the like. U.S. Pat. No. 4,304,061, for example, shows a barrel and shroud construction in which there is a front sight supported at the front of the shroud. A separate rear sight is mounted directly to the handgun frame.

It is an object of the present invention to provide an improved handgun barrel/shroud construction and in particular an improved shroud construction that supports both front and rear handgun sights. With the improved shroud construction of the present invention there is no need for the use of a separate rear sight on the handgun.

Another object of the present invention is to provide an improved barrel and shroud construction for a handgun in which the barrel/shroud combination may be provided in various sizes including long and short barrels and shrouds and in which the combinations are readily interchangeable.

A further object of the present invention is to provide an improved handgun construction as in accordance with the preceding objects and in which a relatively short barrel and shroud combination may be converted readily to a longer barrel and shroud combination with integral rear sight.

Still another object of the present invention is to provide an improved handgun construction as in accordance with the preceding objects and in which the rear sight is adjustable for elevation and windage.

SUMMARY OF THE INVENTION

To accomplish the forgoing and other objects features and advantages of the invention, there is provided a revolver or handgun that comprises a frame and a barrel that is adapted to be received by the frame for support thereof. The barrel is preferably threaded at both ends and is received in a threaded hole in the frame for support thereof. A shroud is provided having a bore for receiving the barrel to thereby surround the barrel along the length thereof. Means are provided such as a nut, for retaining the shroud in fixed position about the barrel and relative to the frame. The shroud has integral therewith an elongated arm that extends rearwardly over the top of the revolver frame for supporting from the rear end thereof a rear sight. The rear sight is disposed adjacent to but just forward of the revolver hammer. The revolver top preferably has an elongated slot extending between the barrel end of the frame and toward the hammer for accommodating the elongated arm of the shroud. The shroud preferably also has a front sight. The shroud has a recess extending therealong for receiving an ejector rod of the revolver and means are provided for aligning the shroud and frame including a locating pin extending from the frame and received in a hole in the shroud. The rear sight preferably includes adjustment means for both elevation and windage.

In one arrangement the barrel may be a short barrel such as a two inch barrel in which case the shroud is also of approximately two inches in length. For this size barrel/shroud there is no rear sight attached thereto. This short barrel/shroud construction may be interchanged with a longer barrel such as a four inch barrel and associated four inch shroud. In this instance the shroud then has the aforementioned elongated arm extending rearwardly for supporting a rear sight. In this way the barrel and shroud can be exchanged so as to convert the handgun from one with a short barrel to one with a longer barrel with an integral adjustable rear sight.

BRIEF DESCRIPTION OF THE DRAWINGS

Numerous other objects features and advantages of the invention should now become apparent upon a reading of the following detailed description taken in conjunction with the accompanying drawings, in which.

DETAILED DESCRIPTION

Figure 1:
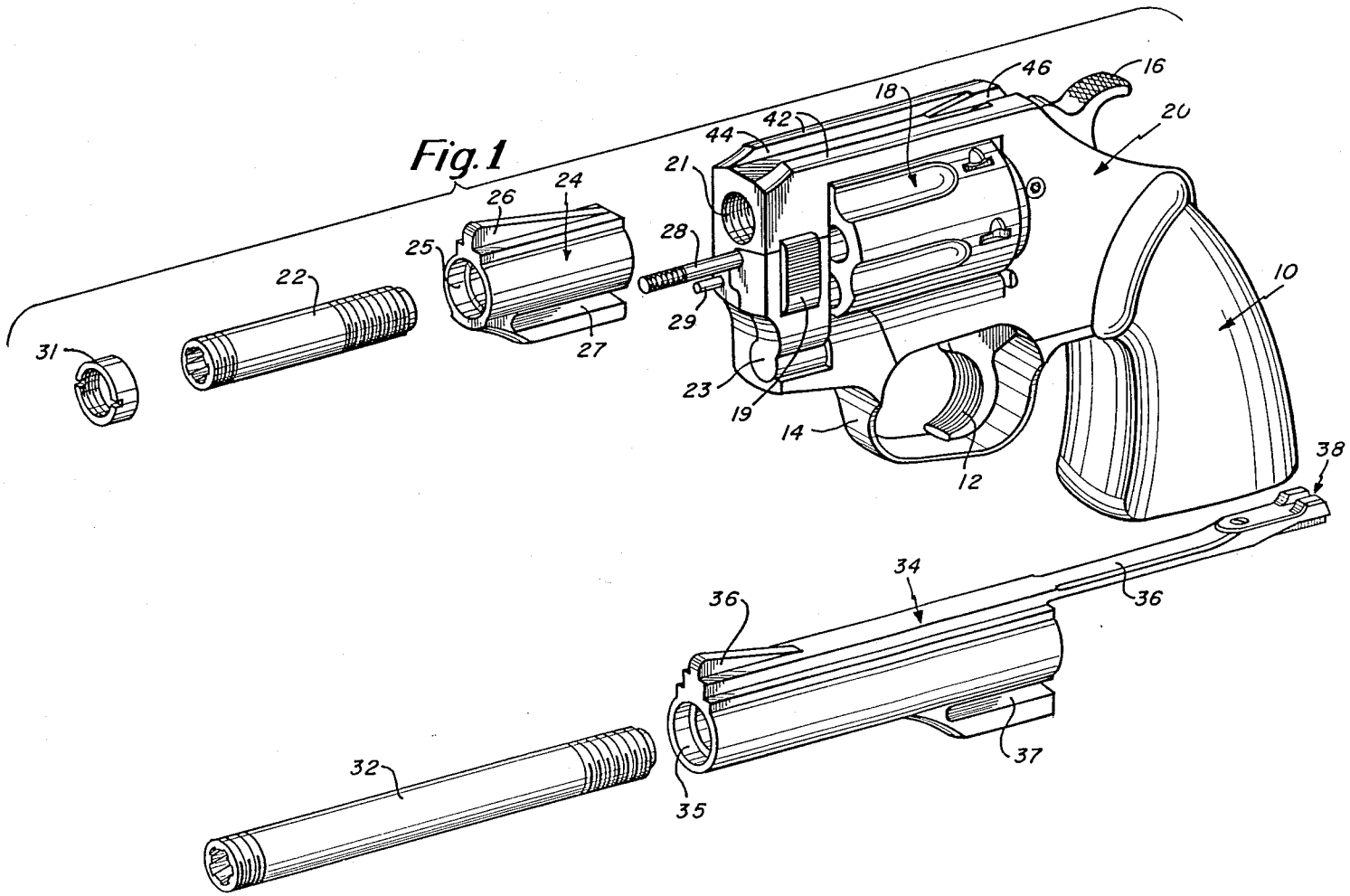
FIG. 1 is and exploded perspective view of a handgun illustrating both the short barrel-shroud construction as well as the long barrel-shroud construction with integral rear sight.

With reference now to the drawings, FIG. 1 shows an exploded perspective view that illustrates both the short barrel 22 and associated short shroud 24 as well as the long barrel 32 and the associated long shroud 34. It is noted that only the long barrel 34 has the rearwardly extending arm 36 for supporting at the rear end thereof the rear sight 38. In the particular embodiment illustrated in FIG. 1 the rear sight is adjustable only for elevation.

FIGS. 2–6 illustrate a handgun having the shorter barrel/shroud secured thereto. FIGS. 7–11 illustrate the handgun with the longer barrel/shroud attached thereto. FIGS. 12–15 illustrate the longer shroud with rear sight adjustable for both elevation and windage.

In accordance with the invention as noted in the drawings, either the short barrel and shroud may be secured to the handgun frame or the longer barrel and shroud with integral rear sight may be secured. The barrel/shroud constructions may be readily removed and interchanged so as to provide flexibility to the user. Moreover, because the rear sight is integral with the longer barrel and shroud there is no need for providing a separate rear sight directly on the handgun frame.

Referring further to the drawings, there is shown a handgun which generally comprises a hand grip 10, a trigger 12, a trigger guard 14, and a hammer 16. There is also provided a handgun cylinder 18 supported within the handgun frame 20. The handgun frame 20 has an internally threaded hole 21 that is adapted to receive one of at least two different length barrels including the barrel 22 illustrated in FIG. 1 or alternatively the barrel 32. The barrel 22 may be a two inch barrel while the barrel 32 may be a four inch barrel. Both of these barrels are threaded at both ends as illustrated.

In association with the small barrel 22, there is provided a short shroud 24 having a front sight 26 and also provided with an elongated recess 27 for receiving the ejector rod 28. FIG. 1 also illustrates the locating pin 29 extending from the frame 20 and adapted to fit in a corresponding hole 30 in the shroud. In this regard, refer to FIG. 2 which shows in dotted outline, the hole 30 and the locating pin 29. This arrangement assures proper registration between the frame 20 and the shroud 24.

Figure 2:
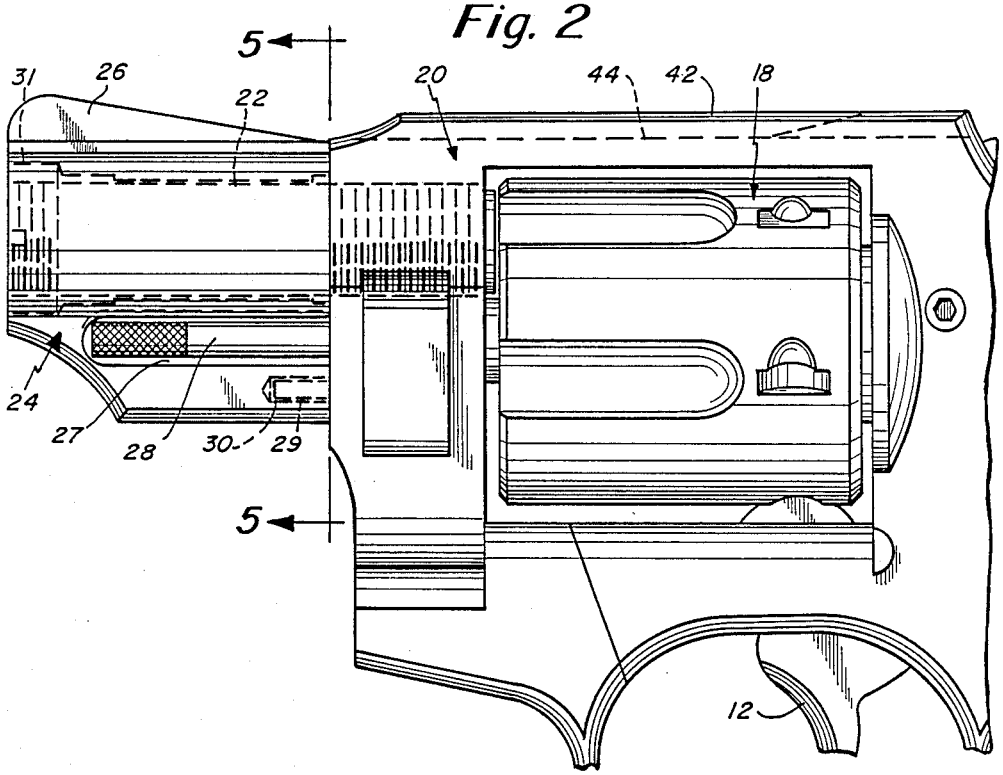
FIG. 2 is a fragmentary side elevation view of the handgun with the short barrel-shroud secured in position.
Figure 3:
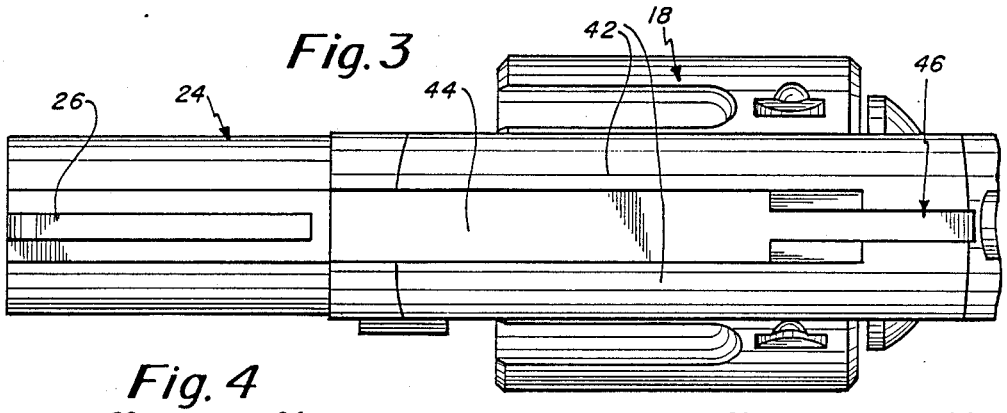
FIG. 3 is a partial top plan view of the handgun illustrated in FIG. 2.
Figure 4:
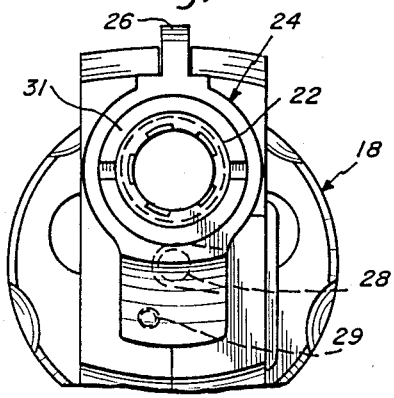
FIG. 4 is a front elevation view of the handgun illustrated in FIGS. 2 and 3.
Figure 5:
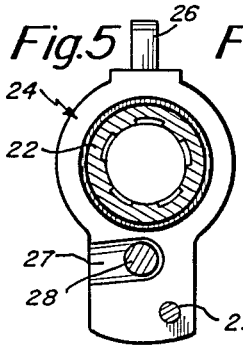
FIG. 5 is a cross-sectional view taken along line 5—5 of FIG. 2.
Figure 6:
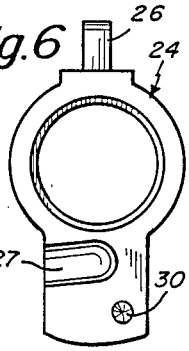
FIG. 6 is a rear elevation view of the shroud used with the short barrel.

As indicated previously, the barrel 22 is threaded at both ends and one of the threaded ends is adapted to be threaded into the threaded hole 21 in the frame 20. The shroud 24 encloses the barrel 22. A spanner nut 31 threads on the opposite end of the barrel 22 and is adapted to seat in the recess 25 in the shroud 24. In this regard, FIG. 2 illustrates in dotted outline, the nut 31 secured to one end of the barrel with the shroud being thus forced into fixed position against the frame. Also in FIG. 2, note the locating pin 29 and the ejector rod 28 disposed in the elongated recess 27.

Inasmuch as the present invention relates primarily to the shroud and barrel construction, the details of operation of the handgun are not described in any detail herein. The handgun has been described as including a trigger 12, trigger guard 14, and hammer 16. There is also provided the ejector rod 28. FIG. 1 also shows the pivot for the crane at 23 and also illustrates the cylinder latch 19. The ejector rod 28 is maintained in the recess 27 when the shroud and barrel are fixed in position on the handgun frame and when the weapon is ready for firing. When the crane assembly is pivoted by operation of the cylinder latch, then the ejector rod 28 may be operated to remove spent shells from the cylinder 18.

The frame 20 of the handgun on its top surface is provided with elongated walls 42 that define therebetween an elongated slot 44. At the rear of the slot 44, the slot is narrowed as indicated at 46 thus functioning as a rear sight in association with the front sight 26 when using the small two inch barrel. Note slot 44 defining the rear sight 46 in FIG. 3. In this embodiment of the shroud there is no separate rear sight; the slot in the frame itself forming a rear sight. This slot 44 is for accommodating the arm 36 of the longer shroud as will be discussed in further detail hereinafter.

FIG. 1 also shows the long shroud 34 having supported at the front end thereof, a front sight 36 and also having a recess 35 for receiving the spanner nut 31. The shroud 34 also includes an elongated recess 37 for receiving the ejector rod and also a hole 38 as depicted in FIG. 7 for receiving the locating pin 29.

FIGS. 7–11 show further details of the longer shroud and barrel construction. In this connection, the barrel may be a four inch barrel so that the shroud is also sized to accommodate the four inch barrel. Unlike the shroud 24, the longer shroud 34 has integrally extending therefrom at its top rear end, the elongated arm 36 having supported at the end thereof, the rear sight 38. Associated with the rear sight 38 is an elevation adjustment screw 39. The adjustment screw 39 is threaded through the arm 36 and bears against the bottom surface of the slot 44. This screw may be threaded in and out to move the rear sight up and down. In this connection, it is preferred that the elongated arm 36 be dimensioned so that it has a certain amount of rigidity yet also has sufficient flexibility to enable the rear sight 38 to deflect as the adjustment screw 39 is turned.

Figure 13:
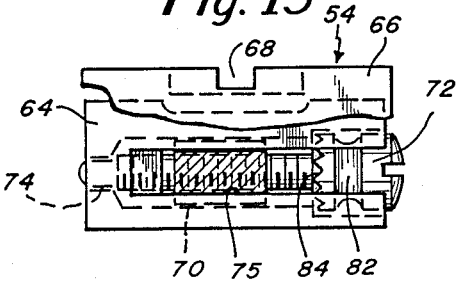
FIG. 13 is a rear view of the rear sight partially sectioned away.
Figure 14:
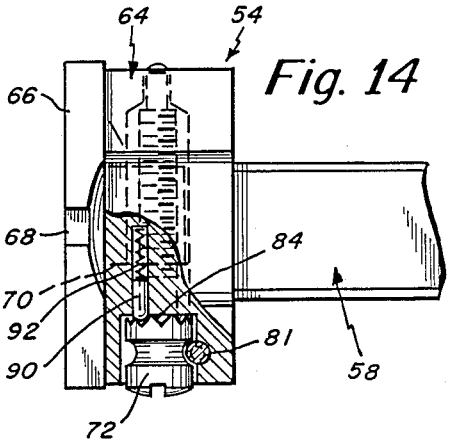
FIG. 14 is a top plan view of the rear sight construction also partially sectioned away to show further details.
Figure 15:
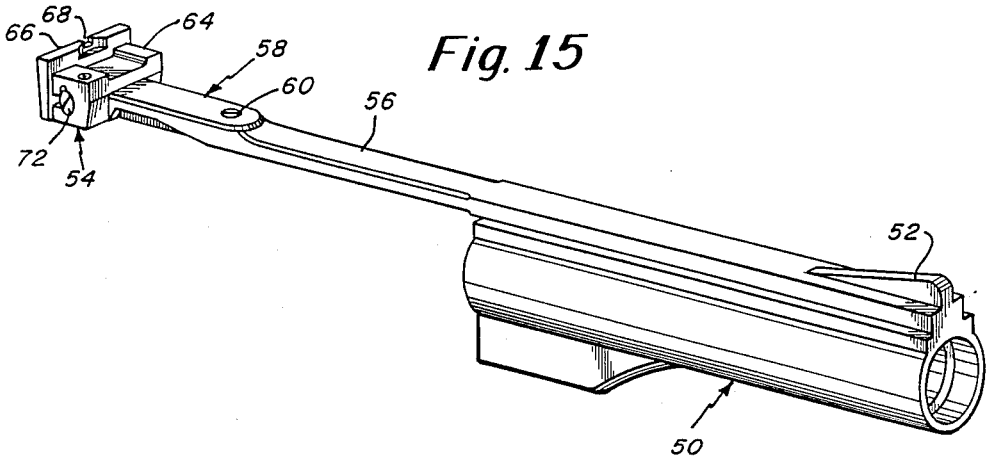
FIG. 15 is a perspective view showing the shroud and rear sight construction with the rear sight being adjustable for windage and elevation as shown in views 12–14.

Reference is now made to FIGS. 12–15 for the illustration of a long shroud 50 adapted to extend about a long barrel of the hand gun and having associated therewith a front sight 52 as illustrated in FIG. 15 along with the rear sight 54 that is adjustable for both windage and elevation. FIG. 15 also shows the elongated arm 56 that extends from the shroud 50 in an integral fashion terminating at the adjustable rear sight 54.

Figure 7:
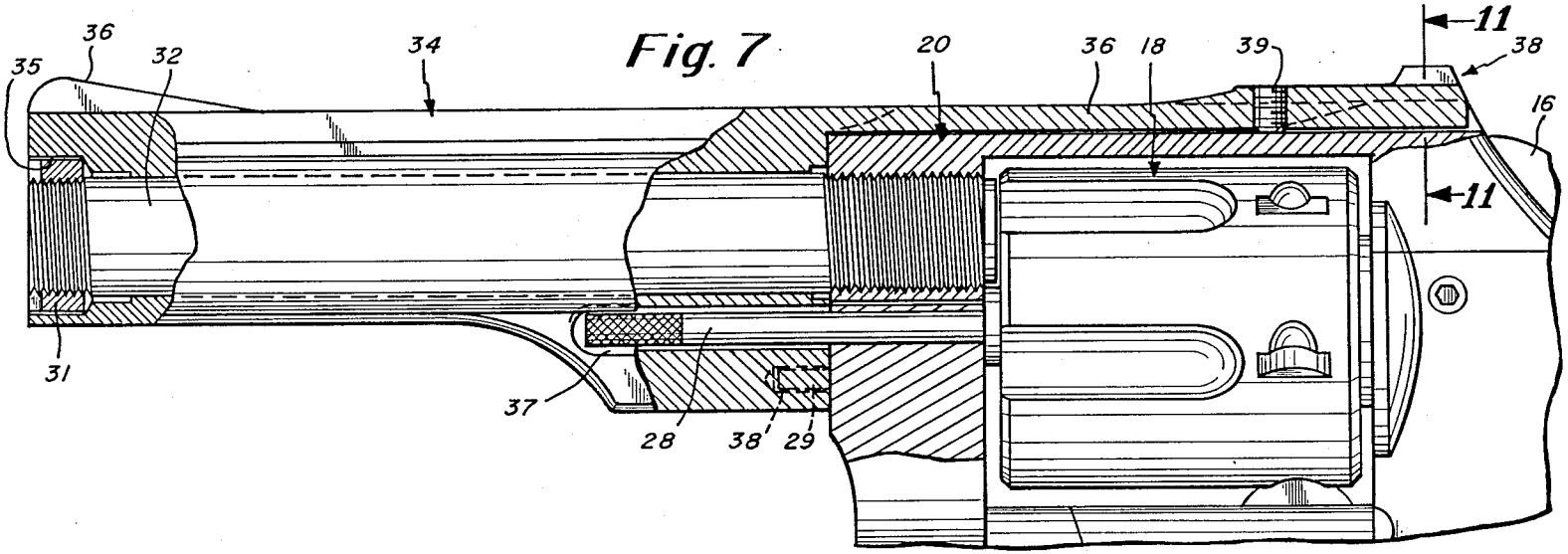
FIG. 7 is a side elevation view partially in cross section of a handgun employing the long barrel-shroud with integral rear sight.
Figure 8:
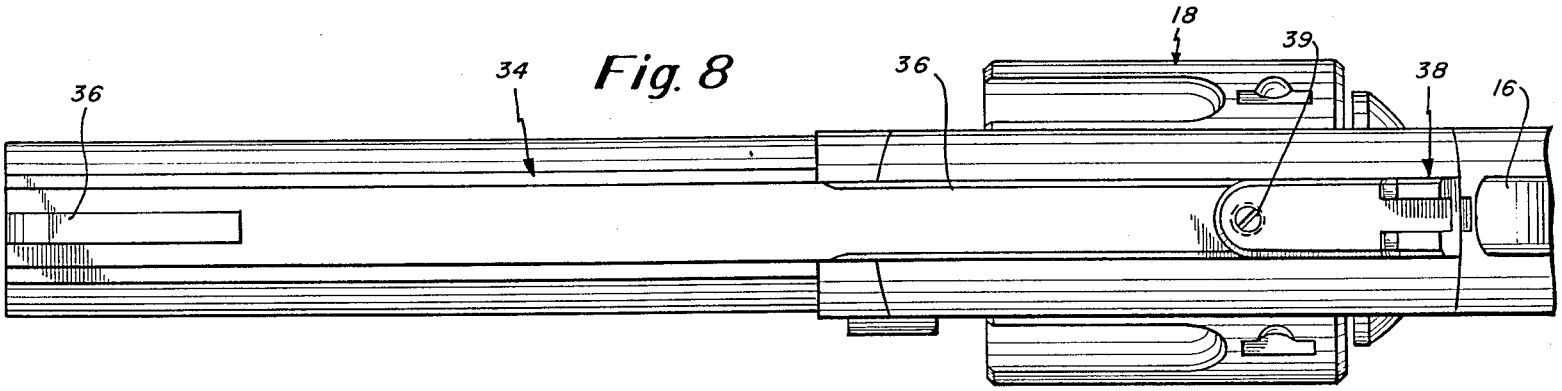
FIG. 8 is a top plan view of the handgun of FIG. 7.
Figure 9:
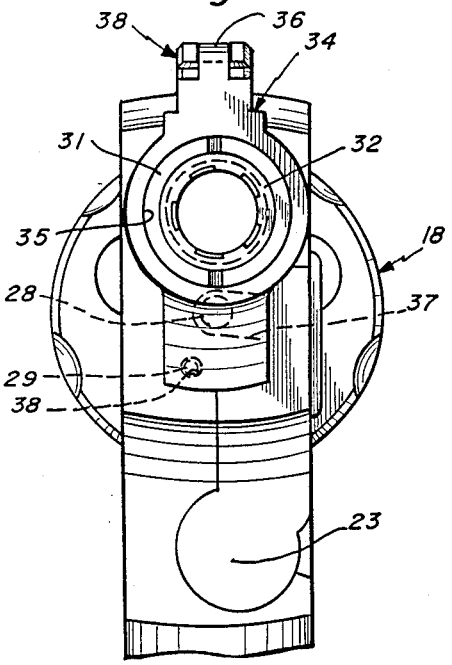
FIG. 9 is a front elevation view of the handgun illustrated in FIGS. 7 and 8.
Figure 10:
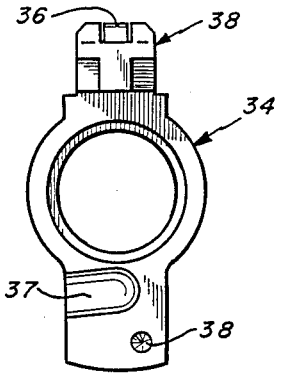
FIG. 10 is a rear elevation view of the shroud used with the long barrel.
Figure 12:
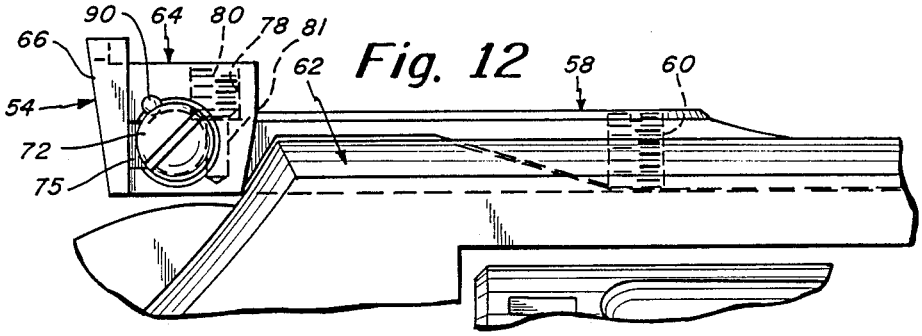
FIG. 12 is a fragmentary side elevation view of an alternate embodiment of the invention employing a rear sight that is adjustable for both windage and elevation.

The elongated arm 56 integral with the shroud 50 terminates in a narrow tongue 58 that is adapted to support the elevation adjustment screw 60 as illustrated in FIG. 12, analogously to the adjustment screw 39 shown in the previous embodiment of FIG. 7.

The arm 56 and the narrow tongue 58 are adapted to fit within a slot on the frame of the handgun as in the previous embodiments. In this connection in FIG. 12 there is disclosed a fragmentary portion of the handgun frame at 62.

The adjustable rear sight 54 is comprised of a main body 64 that is integral with the narrow tongue 58. The rear sight also includes the sight block 66 having a sighting notch at 68. Moreover, integral with the sight block 66 is the support bar 70 that is internally threaded to receive the windage adjustment screw 72. The main body 64 has a transverse elongated slot for receiving the windage adjustment screw 72. FIGS. 13 and 14 show the support for the windage adjustment screw 32 including a bearing support at 74. The windage adjustment screw 72 is maintained in a fixed but rotatable position relative to the main body 64 but as the screw 72 is rotated the threaded engagement of the screw with the support bar 70 causes sideward adjustment of the sight block 66.

As mentioned previously, the sight block 66 is integral with the narrow tongue 58 and includes a dovetail channel 75 for slidably and removably housing the sight block 66 and in particular for receiving the support bar 70 integral therewith. The dovetail channel is of substantially circular shape and is adapted to receive the support bar 70 associated with the sight block 66.

The dovetail channel 74 may have a three step bore having a widened portion at one end for receiving the head of the windage screw 72, a narrower central portion for slidably receiving the support bar 70, and an end portion that is actually a hole in the block for receiving the pin end of the windage screw as illustrated at 74 in FIG. 13. The receiving hole acts as a bushing and rotatably supports the windage screw and the channel 74 when it is turned to adjust the horizontal position of the sight leaf 66.

The main body or block 64 includes a vertically extending threaded bore 78 that opens into the widened portion of the dovetail channel 74. The bore 78 is adapted to receive the screw headed stop pin 80 or set screws so that the pin cooperates with a groove 82 in the head of the windage screw to removably hold both the windage screw and the sight blade 66 in the dovetail channel 75. The pin 72 may of the type described in application Ser. No. 523,336 filed Aug. 2, 1983 and also assigned to the present assignee herein in which the pin has a screw threaded head with a hexagonal opening to accommodate an Allen wrench. When the head is screwed into the bore, a smooth stem, as illustrated at 81 in FIG. 14 fits into the groove 82 and acts as a stop for the windage screw. The stem 81 prevents the screw from being removed from the body 64 or permits it to turn in the dovetail channel 75 to adjust the horizontal position of the sight leaf 66 and associated notch 68.

The head of the windage screw 72 has a straight channel at one end for accommodating a flat-end screw driver or similar tool to turn the screw. As indicated previously, the screw also has an annular groove 82 along the mid length of the head. The head further has a serrated-type edge forming detents 84 at the bottom of the head and an elongated stem with a threaded portion that, as indicated previously terminates in the previously described narrow pin end at 74. The threaded portion of the adjustment screw is adapted to fit snugly into and cooperate with a complimentary threaded bore in the support bar 70 as also indicated previously.

Figure 11:
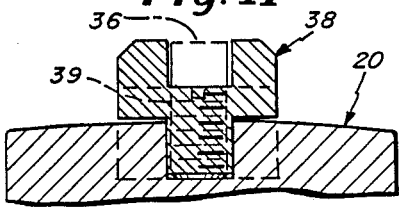
FIG. 11 is a cross sectional view taken along line 11—11 of FIG. 7 illustrating further details of the rear sight which is adjustable for elevation only.

With further regard to the windage adjustment screw 72, and the serrated edge 84, it is noted that this edge cooperates, as illustrated in FIG. 11, with a detent plunger 90 and associated coil spring 92. The tip of the detent plunger 90 and the serrated edge 84 combine to produce a fine clicking action to tell the user exactly how much the screw has to be turned to adjust the sighting blade to the desired position. For further details of the assembly of the rear sight construction reference is made to my aforementioned copending application Ser. No. 523,336 now granted as U.S. Pat. No. 4,606,131, which issued Aug. 19, 1986

Having now describe a preferred embodiment of the present invention it should now be apparent to those skilled in the art that numerous other embodiments and modifications thereof are contemplated as falling within the scope of the present invention as defined by the appended claims.

What is claimed is:

1. A revolver comprising; a frame, a hammer supported from the frame, a barrel, means on the frame for receiving and supporting the barrel extending therefrom, a substantially cylindrical shroud having a bore for receiving the barrel to thereby surround the barrel along a length thereof, means for retaining the shroud in fixed position about the barrel and relative to the frame, said shroud having integral therewith an elongated arm extending rearwardly from the top side thereof and over the top of the revolver frame for supporting from the rear end thereof a rear sight disposed adjacent to but just forward of the revolver hammer, said elongated arm being narrower than either the shroud maximum diameter or the frame maximum width, in combination with an elongated slot in the top of the revolver frame extending in a direction between the barrel end of the frame and the hammer and for accommodating said elongated arm, said elongated arm disposed securely in said frame slot when the shroud and barrel are secured on the frame.

2. A revolver as set forth in claim 1 wherein said shroud has a front sight and said elongated arm is integral with and cantilevers from said shroud in a manner to retain said arm fully seated in the frame slot.

3. A revolver comprising: a frame, a hammer supported from the frame, a barrel means on the frame for receiving and supporting the barrel, extending therefrom, a substantially cylindrical shroud having a bore for receiving the barrel to thereby surround the barrel along a length thereof, means for retaining the shroud in fixed position about the barrel and relative to the frame, said shroud having integral therewith an elongated arm extending rearwardly from the top side thereof and over the top of the revolver frame for supporting from the rear and thereof a rear sight disposed adjacent to but just forward of the revolver hammer, said elongated arm being narrower than either the shroud maximum diameter or the frame maximum width, the top surface of the revolver frame and said elongated arm having cooperative interlocking surfaces extending in a direction between the barrel end of the frame and the hammer, said elongated arm being integral with and cantilevered from said shroud and disposed to provide retention of said arm with said frame when the shroud and barrel are secured on the frame.

4. A revolver as set forth in claim 3 wherein said means for retaining the shroud comprises a nut received in a recess in the shroud bore and threaded onto a threaded end of the barrel.

5. A revolver as set forth in claim 4 wherein said barrel is threaded at both ends and is received in a threaded hole in the frame.

6. A revolver as set forth in claim 3 wherein said barrel has an outer diameter just less than the inner diameter of the shroud bore to provide a clearance fit therebetween.

7. A revolver as set forth in claim 3 wherein said shroud has a recess extending therealong for receiving an ejector rod of the revolver.

8. A revolver as set forth in claim 3 including means for aligning the shroud and frame so that the front and rear sights are in alignment.

9. A revolver as set forth in claim 8 wherein said means for aligning includes a locating pin extending from the frame and received in a hole in the shroud.

10. A revolver as set forth in claim 3 including elevation adjustment means at the rear sight.

11. A revolver as set forth in claim 10 including windage adjustment means at the rear sight.

12. A revolver as set forth in claim 11 wherein said windage adjustment means comprises a main support block integral with said elongated arm, a sight blade having a sight notch and a windage adjustment screw intercoupling said main body and sight blade.

13. A revolver as set forth in claim 12 wherein the windage screw includes a serrated edge that cooperates with a spring biased detent plunger for producing a clicking action during turning of the screw.

14. A revolver as set forth in claim 13 wherein the head of the windage adjustment screw has an annular channel for receiving a pin for enabling rotation of the windage screw but preventing axial motion thereof relative to the main body.

15. A revolver as set forth in claim 14 wherein said sight blade has a cylindrical support bar that is internally threaded and received in a dovetail channel of the main body with the windage adjustment screw being threadedly engaged with the cylindrical support bar.

16. A revolver as set forth in claim 3 wherein said elongated arm is integral with and cantilevers from said shroud, said elongated arm having limited up and down flexibility, and means on said elongated arm interacting with the top of the revolver frame for adjusting the elevation of said rear sight.

17. A revolver as set forth in claim 16 wherein said frame top is slotted to receive said elongated arm and said means for adjusting elevation includes an adjusting screw in said arm bearing against the base of the frame slot.

18. A revolver as set forth in claim 3 wherein the revolver frame has an elongated slot in its top surface that defines with said elongated arm the cooperatively interlocking surfaces.

19. A revolver as set forth in claim 18 wherein said arm extends from a position on the shroud that is at substantially the same location where the barrel engages with the frame.

* * * * *